US012760493B2

(12) United States Patent
Ueta et al.

(10) Patent No.: US 12,760,493 B2
(45) Date of Patent: Oct. 13, 2026

(54) WORK MACHINE

(71) Applicant: KOBELCO CONSTRUCTION MACHINERY CO., LTD., Hiroshima (JP)

(72) Inventors: Toshiro Ueta, Hiroshima (JP); Michio Hirayama, Hiroshima (JP); Kazuomi Endo, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 736 days.

(21) Appl. No.: 17/768,136

(22) PCT Filed: Oct. 16, 2020

(86) PCT No.: PCT/JP2020/039030
§ 371 (c)(1),
(2) Date: Apr. 11, 2022

(87) PCT Pub. No.: WO2021/085167
PCT Pub. Date: May 6, 2021

(65) Prior Publication Data

US 2024/0301652 A1 Sep. 12, 2024

(30) Foreign Application Priority Data

Oct. 31, 2019 (JP) ..... 2019-198307

(51) Int. Cl.
*E02F 3/43* (2006.01)
*E02F 9/26* (2006.01)

(52) U.S. Cl.
CPC ..... *E02F 3/437* (2013.01); *E02F 9/265* (2013.01)

(58) Field of Classification Search
CPC ..... E02F 9/2267; E02F 9/2264; E02F 9/2253; E02F 9/2203; E02F 9/22; E02F 9/2025;
(Continued)

(56) References Cited

U.S. PATENT DOCUMENTS

2011/0062104 A1* 3/2011 Schneider ..... B66C 23/905 212/276
2012/0310494 A1* 12/2012 Asami ..... F16H 61/472 701/50

(Continued)

FOREIGN PATENT DOCUMENTS

CN 108291387 A 7/2018
JP H11336130 A * 12/1999

(Continued)

OTHER PUBLICATIONS

Machine Translation of the Description of JP-2014167231-A, Togo et al., pp. 1-7 (Year: 2014).*

(Continued)

*Primary Examiner* — Anne Marie Antonucci
*Assistant Examiner* — Jared C Bean
(74) *Attorney, Agent, or Firm* — Oblon, McClelland, Maier & Neustadt, L.L.P.

(57) ABSTRACT

A work machine includes: a reference posture setting part which sets a reference posture which is one of postures of a working device in a holding task; an estimative load determination part which determines, based on a load acquired by a load acquisition section, an estimative load of an object of a work estimated to be discharged at a position above a loading destination in a discharge task when a predetermined estimative load determinative criterion is satisfied; an output part which outputs an estimative result which is information about the estimative load determined by the estimative load determination part. The estimative load (Continued)

determinative criterion includes a criterion that a posture change amount representing a changed degree of the posture of the working device from the reference posture is equal to or larger than a predetermined change amount threshold for determination of the estimative load.

14 Claims, 6 Drawing Sheets

(58) Field of Classification Search
CPC ..... E02F 9/20; E02F 3/42; E02F 3/40; E02F 3/34; E02F 3/36; E02F 3/28; E02F 3/43; E02F 3/30; E02F 9/264; E02F 3/435; G01G 19/083
See application file for complete search history.

(56) References Cited

U.S. PATENT DOCUMENTS

| | | | | |
|---|---|---|---|---|
| 2014/0231153 | A1 | 8/2014 | Fukasu et al. | |
| 2018/0251956 | A1* | 9/2018 | Hoshaku | E02F 9/2037 |
| 2018/0274210 | A1 | 9/2018 | Nishimura et al. | |
| 2019/0277004 | A1* | 9/2019 | Hashimoto | G01B 11/00 |
| 2020/0011029 | A1* | 1/2020 | Sano | E02F 9/265 |
| 2020/0018037 | A1* | 1/2020 | Nakamura | E02F 3/43 |
| 2020/0040554 | A1 | 2/2020 | Nishimura | |
| 2020/0095751 | A1* | 3/2020 | Nishimura | E02F 9/264 |
| 2020/0208373 | A1* | 7/2020 | Nakamura | G01G 19/08 |
| 2020/0232189 | A1* | 7/2020 | Yamanobe | E02F 9/26 |
| 2020/0283992 | A1* | 9/2020 | Nakamura | G07C 3/08 |
| 2022/0098009 | A1* | 3/2022 | Minami | B66C 23/905 |

FOREIGN PATENT DOCUMENTS

| | | | | |
|---|---|---|---|---|
| JP | 2000-64360 | A | | 2/2000 |
| JP | 2002-21122 | A | | 1/2002 |
| JP | 2003-73078 | A | | 3/2003 |
| JP | 2008-37562 | A | | 2/2008 |
| JP | 2014167231 | A | * | 9/2014 |
| JP | 2017-166232 | A | | 9/2017 |
| JP | 2018-188831 | A | | 11/2018 |
| JP | 2019-49103 | A | | 3/2019 |
| JP | 2019-60132 | A | | 4/2019 |
| JP | 2019-65655 | A | | 4/2019 |

OTHER PUBLICATIONS

Machine Translation of description of JP-H11336130-A, Kajima, 1999 (Year: 2025).*
Machine translation of JP-H11336130-A, Kajima, Dec. 7, 1999, pp. 1-5 (Year: 2025).*
Machine translation of JP-2014167231-A, Togo et al., Sep. 11, 2014, pp. 1-7 (Year: 2025).*
Machine translation of the description of JP-2014167231-A, published Sep. 11, 2014, Togo et al. (Year: 2025).*
Extended European Search Report issued Oct. 28, 2022 in European Patent Application No. 20880762.8, 7 pages.
International Search Report mailed on Dec. 15, 2020 in PCT/JP2020/039030 filed on Oct. 16, 2020 (2 pages).
Combined Office Action and Search Report issued Dec. 5, 2022, in Chinese Patent Application No. 202080074085.1 (with English Summary of Office Action Only), 8 pages.

* cited by examiner

WORK MACHINE

TECHNICAL FIELD

The present invention relates to a work machine, such as a hydraulic excavator.

BACKGROUND ART

Work machines, such as hydraulic excavators, have been conventionally known. Each of the hydraulic excavators includes a machine body and a working device movable relative to the machine body, the working device including: a boom; an arm; and a bucket. The hydraulic excavator performs a holding task of holding an object of a work, such as soil and sand, by an attachment, such as a bucket, and a loading work for loading the held object to a loading destination, e.g., a dump truck, on a work site. The loading work includes a discharge task of discharging the held object at a position above the loading destination. The hydraulic excavator is known to be mounted with a payload function. The payload function serves to measure a load of the soil and sand held by the bucket. The hydraulic excavator can calculate an amount of the soil and sand loaded to the dump truck in the loading work by operably executing the payload function when performing the loading work. The hydraulic excavator can, for example, calculate an amount of the soil and sand for each loading work repeated a plurality of times, calculate a total amount of the soil and sand discharged to the dump truck, and cause a display device to display the calculated total amount of the soil and sand thereon. In this manner, an operator can grasp the total amount of the soil and sand loaded to the dump truck.

Meanwhile, the hydraulic excavator performs various works or operations in addition to the loading work on the work site. From this perspective, the hydraulic excavator needs to determine whether a work or operation performed by the hydraulic excavator in calculation of the amount of the soil and sand is the loading work so that the operator can properly grasp the total amount of the soil and sand to be loaded to the dump truck.

Patent Literature 1 discloses a technology for properly grasping a load of an excavated matter loaded to a dump truck by accurately detecting a loading work (loading operation) to the dump truck (Paragraph of Patent Literature 1). In a hydraulic excavator disclosed in Patent Literature 1, a work of the hydraulic excavator is determined as the loading work for loading the excavated matter to the dump truck under the condition that the bucket has moved across a reference height level, and a load value of a load is determined by a loading determination unit (paragraphs [0104] to [0107] of Patent Literature 1). The reference height level is set by a user of the hydraulic excavator (paragraph of Patent Literature 1).

Patent Literature 2 discloses a technology of determining a work of moving a bucket containing soil and sand to a hopper when a boom angle passes through a boom boundary angle from below. The boom boundary angle is a predetermined angle set in either an upper direction or a lower direction from a horizontal position of the hydraulic excavator (paragraph of Patent Literature 2). The boom boundary angle is set by an operator of the hydraulic excavator (paragraphs [0033], [0047] of Patent Literature 2).

However, a height level difference between a height level (work machine location height level) of the ground where the work machine, such as the hydraulic excavator, is located, and a height level (truck location height level) of the ground where the dump truck is located varies depending on a situation of a work site. Hence, in the loading work, a height level to which the bucket is raised for loading the soil and sand to the dump truck, i.e., the height level of the bucket to the machine body, differs depending on the situation of the work site. It is seen from these perspectives that the technology disclosed in Patent Literature 1 requires an operator of the hydraulic excavator to perform a cumbersome setting operation of changing the setting of the reference height level depending on a situation of the work site. Besides, in the loading work, a boom angle at which the boom rises to load the soil and sand to the dump truck, i.e., a boom angle to the machine body, differs depending on the situation of the work site. Accordingly, the technology disclosed in Patent Literature 2 requires an operator of the hydraulic excavator to perform a cumbersome setting operation of changing the setting of the boom boundary angle depending on a situation of the work site.

CITATION LIST

Patent Literature

Patent Literature 1: Japanese Unexamined Patent Publication No. 2018-188831

Patent Literature 2: Japanese Unexamined Patent Publication No. 2002-021122

SUMMARY OF INVENTION

The present invention has an object of providing a work machine which can reduce a burden on an operator attributed to a setting operation depending on a situation of a work site, and output information about a load of an object estimated to be discharged at a position above a loading destination in a discharge task.

Provided is a work machine which performs a holding task of holding an object of a work, and a discharge task of discharging the object at a position above a loading destination. The work machine includes: a machine body; a working device which includes a boom supported on the machine body tiltably in a rising direction and a lowering direction, and an attachment for holding the object in the holding task; a posture acquisition section which acquires a posture of the working device; a load acquisition section which acquires a load of the object held by the attachment; a reference posture setting part which sets a reference posture which is one of postures of the working device in the holding task; an estimative load determination part which determines, based on the load acquired by the load acquisition section, an estimative load of the object estimated to be discharged at the position above the loading destination in the discharge task when a predetermined estimative load determinative criterion is satisfied; and an output part which outputs an estimative result which is information about the estimative load determined by the estimative load determination part. The estimative load determinative criterion includes a criterion that a posture change amount representing a changed degree of the posture of the working device from the reference posture is equal to or larger than a predetermined change amount threshold for determination of the estimative load.

DESCRIPTION OF EMBODIMENTS

Hereinafter, a preferable embodiment of the present invention will be described with reference to the accompanying drawings.

Figure 1:
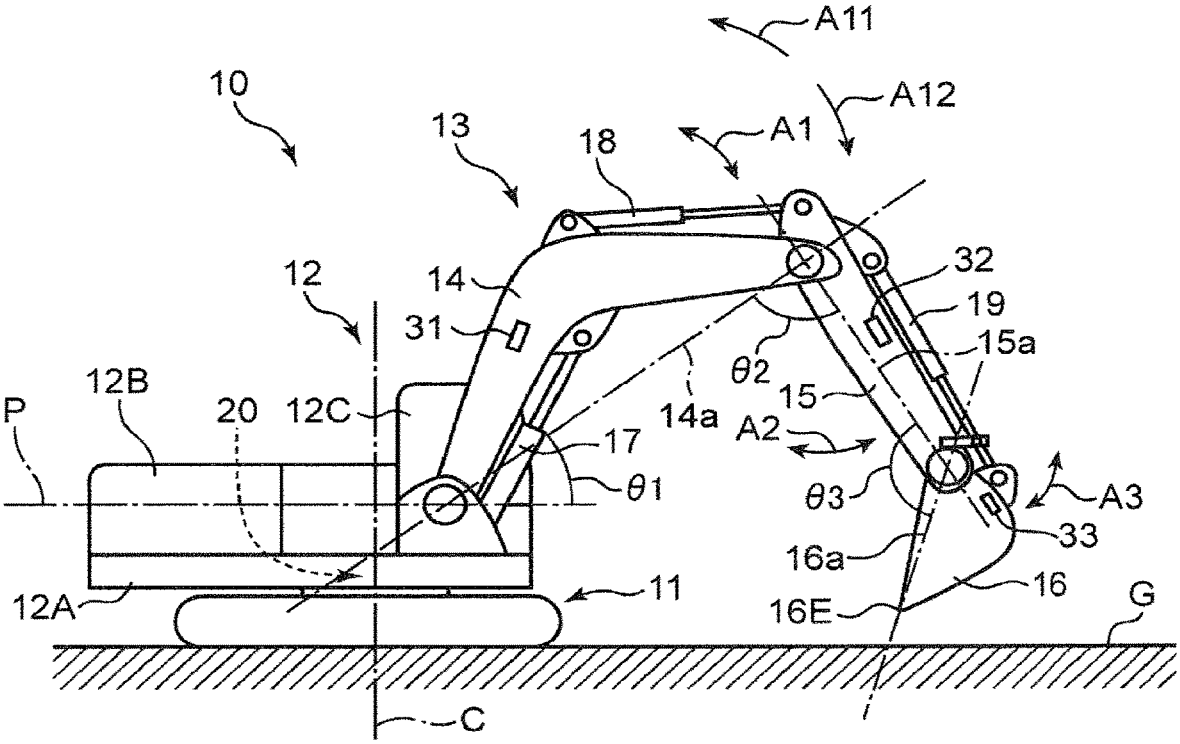
FIG. 1 is a sideview of a hydraulic excavator which is an example of a work machine according to an embodiment of the present invention.
Figure 2:
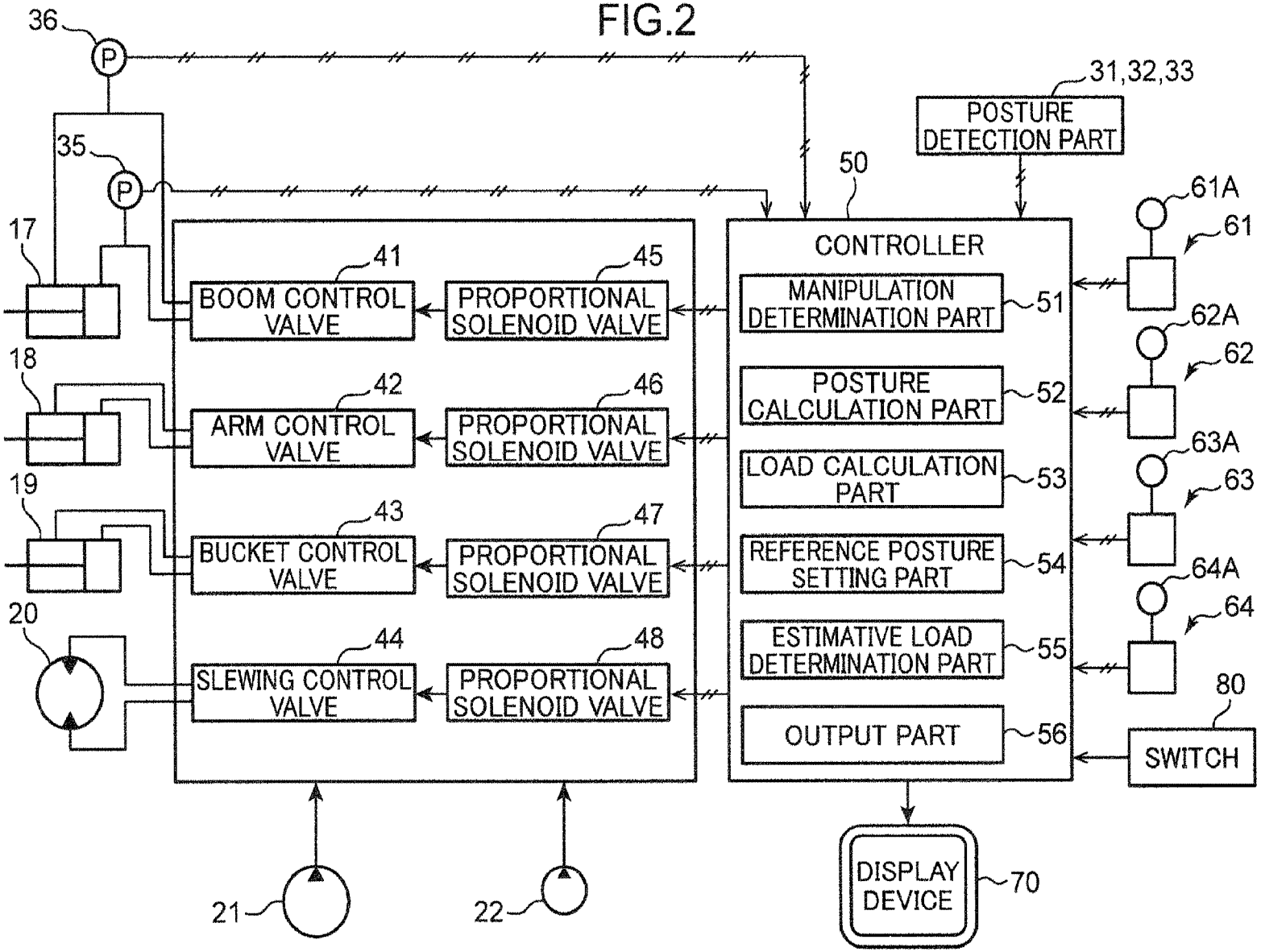
FIG. 2 is a view showing a configuration of a controller mounted on the hydraulic excavator and a circuit controlled by the controller.

FIG. 1 shows a hydraulic excavator which is an example of a work machine according to an embodiment of the present invention. FIG. 2 is a view showing a configuration of a controller mounted on the hydraulic excavator and a circuit controlled by the controller.

As shown in FIG. 1 and FIG. 2, a hydraulic excavator 10 includes: a lower traveling body 11; an upper slewing body 12 slewably mounted on the lower traveling body 11; a working device 13 mounted on the upper slewing body 12; a plurality of hydraulic actuators; at least one hydraulic pump 21; a pilot pump 22; a plurality of manipulation devices; a plurality of control valves; a plurality of pressure sensors; a posture detection part; a switch 80; and a controller 50.

The lower traveling body 11 and the upper slewing body 12 constitute a machine body which supports the working device 13. The lower traveling body 11 has an unillustrated traveling device causing the hydraulic excavator 10 to travel, and thus can travel on the ground G. The upper slewing body 12 has a slewing frame 12A, and an engine room 12B and a cab 12C mounted thereon. The engine room 12B accommodates an engine, and the cab 12C has a seat which allows an operator to sit thereon, various manipulation levers, and manipulation pedals.

The working device 13 includes a plurality of movable parts which can perform a holding task of holding soil and sand, and a loading work for loading the soil and sand being held to a load bed of a dump truck. The movable parts include a boom 14, an arm 15, and a bucket 16. The soil and sand exemplifies an object of the work, the load bed of the dump truck exemplifies a loading destination, and the bucket 16 exemplifies an attachment.

In the embodiment, the holding task includes a task (excavation task) of excavating soil and sand of the ground on a work site by the bucket 16 and holding the excavated soil and sand by the bucket 16. The loading work includes moving the bucket 16 holding the soil and sand from the ground where the holding task is performed to a position right above the load bed of the dump truck and discharging the soil and sand from the bucket 16 above the dump truck. The soil and sand discharged from the bucket 16 drops from the bucket 16 to be loaded to the load bed of the dump truck. In other words, the loading work includes a carrying task of carrying the bucket 16 holding the soil and sand from the ground to a position right above the load bed of the dump truck, and a discharge task of discharging the soil and sand held by the bucket 16 at the position above the dump truck.

The boom 14 has a proximal end supported on a front portion of the slewing frame 12A tiltably, i.e., rotatably about a horizontal axis, as indicated by arrow A1 in FIG. 1, and a distal end opposite to the proximal end. Specifically, the boom 14 performs a boom raising operation of operating in a rising direction A11, and a boom lowering operation of operating in a lowering direction A12.

The arm 15 has a proximal end attached to the distal end of the boom 14 rotatably about a horizontal axis as indicated by arrow A2 in FIG. 1, and a distal end opposite to the proximal end. The bucket 16 has a proximal end attached to the distal end of the arm 15 rotatably about a horizontal axis as indicated by arrow A3 in FIG. 1.

The hydraulic actuators include a plurality of hydraulic cylinders and a slewing motor 20. The hydraulic cylinders include at least one boom cylinder 17 which moves the boom 14, an arm cylinder 18 which moves the arm 15, and a bucket cylinder 19 which moves the bucket 16. Although FIG. 2 illustrates only the singe hydraulic pump 21, the hydraulic excavator 10 may include a plurality of hydraulic pumps.

The at least one boom cylinder 17 is located between the upper slewing body 12 and the boom 14, and extends or contracts by receiving a supply of a hydraulic fluid discharged from the hydraulic pump 21 to thereby cause the boom 14 to rotate in the rising direction A11 or the lowering direction A12. The rising direction A11 is a direction in which the distal end of the boom 14 moves away from the ground G, and the lowering direction A12 is a direction in which the distal end of the boom 14 moves closer to the ground G.

The arm cylinder 18 is located between the boom 14 and the arm 15, and extends or contracts by receiving a supply of the hydraulic fluid to thereby rotate the arm 15 in an arm pulling direction or an arm pushing direction indicated by the arrow A2. The arm pulling direction is a direction in which the distal end of the arm 15 moves closer to the boom 14, and the arm pushing direction is a direction in which the distal end of the arm 15 moves away from the boom 14.

The bucket cylinder 19 is located between the arm 15 and the bucket 16, and extends or contracts by receiving a supply of the hydraulic fluid to thereby rotate the bucket 16 in a bucket pulling direction or a bucket pushing direction indicated by the arrow A3. The bucket pulling direction is a direction in which an angle θ3 between a straight line 15*a* representing a longitudinal direction of the arm 15 shown in FIG. 1 and a straight line 16*a* representing a direction of the bucket 16 decreases, and the bucket pushing direction is a direction in which the angle θ3 increases.

The slewing motor 20 is a hydraulic motor which operates to slew the upper slewing body 12 by receiving a supply of the hydraulic fluid. The slewing motor 20 has an unillustrated output shaft which rotates by receiving a supply of the hydraulic fluid and is connected to the upper slewing body 12 for slewing the upper slewing body 12 in left and right directions. Specifically, the slewing motor 20 has a pair of ports for receiving a supply of the hydraulic fluid to one of the ports so that the output shaft rotates in a direction corresponding to the one of the ports, and discharging the hydraulic fluid from the other of the ports.

As shown in FIG. 2, the manipulation devices include a boom manipulation device 61, an arm manipulation device 62, a bucket manipulation device 63, and a slewing manipulation device 64. The manipulation devices 61 to 64 respectively have manipulation levers for each receiving a manipulation by the operator. Specifically, the boom manipulation device 61 has a boom manipulation lever 61A, the arm manipulation device 62 has an arm manipulation lever 62A, the bucket manipulation device 63 has a bucket manipulation lever 63A, and the slewing manipulation device 64 has a slewing manipulation lever 64. Each of the manipulation devices may be constituted by a hydraulic manipulation device or an electric manipulation device. FIG. 2 shows a circuit configuration for the manipulation devices 61 to 64 each constituted by the electric manipulation device.

Figure 3:
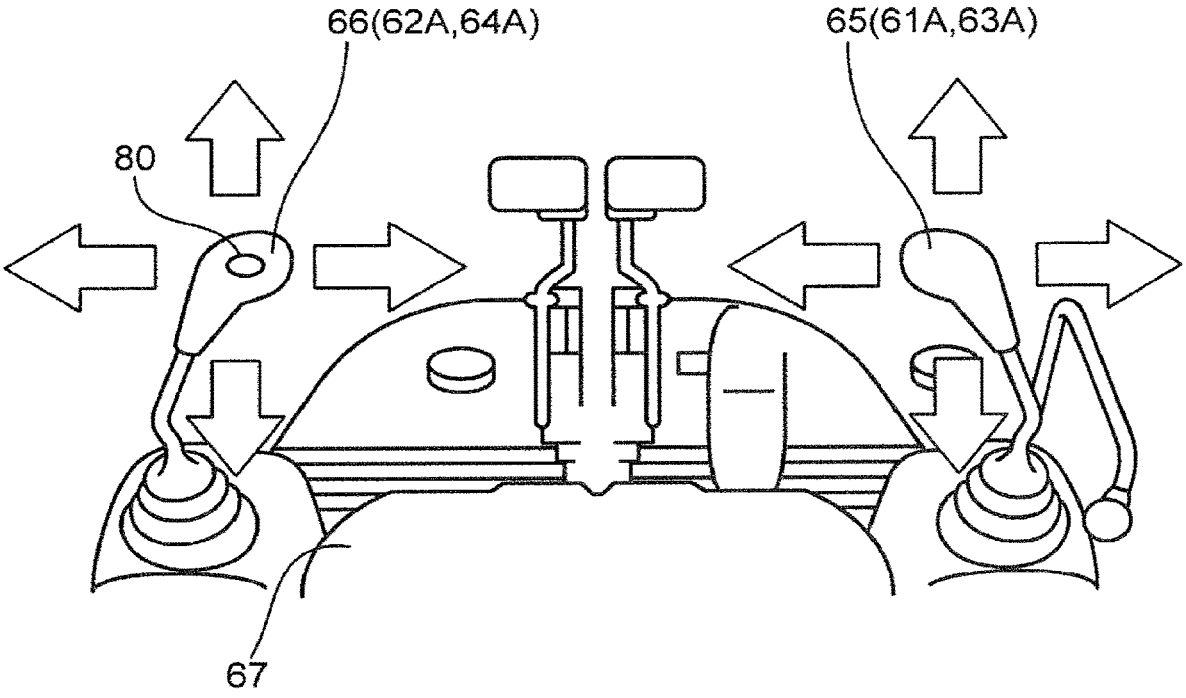
FIG. 3 is a perspective view showing a right manipulation lever and a left manipulation lever mounted to the hydraulic excavator.

A specific example for the manipulation devices is shown in FIG. 3. FIG. 3 is a perspective view showing a right manipulation lever 65 and a left manipulation lever 66 mounted to the hydraulic excavator 10. In the specific example shown in FIG. 3, one manipulation lever serves as a plurality of manipulation levers. The right manipulation lever 65 is located at a right position of a seat 67 which allows the operator to sit thereon, and the left manipulation lever 66 is located at a left position of the seat 67. The right manipulation lever 65 serves as the boom manipulation lever 61A when manipulated in the front-rear direction, and serves as the bucket manipulation lever 63A when manipulated in the left-right direction. The left manipulation lever 66 serves as the arm manipulation lever 62A when manipulated in the front-rear direction, and serves as the slewing manipulation lever 64A when manipulated in the left-right direction. The functions (lever patterns) which the right manipulation lever 65 and the left manipulation lever 66 respectively have may be appropriately changed depending on a manipulation instruction from the operator.

The control valves include a boom control valve 41, an arm control valve 42, a bucket control valve 43, a slewing control valve 44, a pair of boom proportional solenoid valves 45, a pair of arm proportional solenoid valves 46, a pair of bucket proportional solenoid valves 47, and a pair of slewing proportional solenoid valves 48.

For example, when the boom manipulation lever 61A is manipulated, information about a manipulation amount and a manipulation direction of the boom manipulation lever 61A is converted to an electric signal (manipulation signal) and the manipulation signal is input to the controller 50. The controller 50 inputs an instruction signal (instruction current) corresponding to the manipulation signal to either of the boom proportional solenoid valves 45 that corresponds to the manipulation direction of the boom manipulation lever 61A. The corresponding boom proportional solenoid valve 45 reduces a pressure of a pilot oil discharged from the pilot pump 22 in response to the instruction signal, and guides the reduced pilot pressure to either of the pair of pilot ports of the boom control valve 41. Accordingly, the boom control valve 41 opens in a direction corresponding to the pilot port to which the pilot pressure is input at a stroke corresponding to the pilot pressure. This results in permitting the hydraulic fluid discharged from the hydraulic pump 21 to flow into a head chamber or a rod chamber of the boom cylinder 17 at a flow rate corresponding to the stroke. Each of the manipulation levers 62A, 63A, 64A of the remaining manipulation devices 62, 63, 64 is manipulated in the same manner as the case described above, and thus description therefor will be omitted.

Although a hydraulic circuit for each manipulation device of a hydraulic type is unillustrated here, such a hydraulic circuit included in the hydraulic excavator 10 acts as described below. For example, when the boom manipulation lever 61A is manipulated, a pilot primary pressure from the pilot pump 22 is reduced by a remote-control valve of the boom manipulation device 61 depending on the manipulation amount of the boom manipulation lever 61A, and the reduced pilot pressure is output from the remote-control valve. The output pilot pressure is input to either of the pair of pilot ports of the boom control valve 41. Accordingly, the boom control valve 41 opens in a direction corresponding to the pilot port to which the pilot pressure is input at a stroke corresponding to the pilot pressure. This results in permitting the hydraulic fluid discharged from the hydraulic pump 21 to flow into a head chamber or a rod chamber of the boom cylinder 17 at a flow rate corresponding to the stroke.

As shown in FIG. 2, the pressure sensors include a pressure sensor 35 which detects a head pressure of the boom cylinder 17 and a pressure sensor 36 which detects a rod pressure of the boom cylinder 17.

The posture detection part detects posture information about a posture of the working device to the upper slewing body 12 constituting a part of the machine body. The posture detection part includes a boom posture detector 31 which can detect posture information on the boom 14, an arm posture detector 32 which can detect posture information on the arm 15, and a bucket posture detector 33 which can detect posture information on the bucket 16. In the embodiment, each of the posture detectors 31, 32, 33 is composed of, for example, an Inertial Measurement Unit (IMU).

Each of the posture detectors 31, 32, 33 may include a stroke sensor, may include an angle sensor, or may include a position detector utilizing a satellite positioning system. Specifically, a posture of the boom 14, a posture of the arm 15, and a posture of the bucket 16 may be calculated, for example, based on a stroke value of a stroke of each of the boom cylinder 17, the arm cylinder 18, and the bucket cylinder 19 as detected by the stroke sensor. The posture of the boom 14, the posture of the arm 15, and the posture of the bucket 16 may be calculated, for example, based on an angle value obtained by the angle sensor provided to each of a rotary shaft at the proximal end of the boom 14, a rotary shaft at the proximal end of the arm 15, and a rotary shaft at the proximal end of the bucket 16. Each of the posture of the boom 14, the posture of the arm 15, and the posture of the bucket 16 may be calculated, for example, based on a detection value obtained by the position detector utilizing the satellite positioning system, e.g., a GNSS sensor.

The posture information (posture signal) about each of the posture of the boom 14, the posture of the arm 15, and the posture of the bucket 16 detected by the posture detection part in the manner described above is input to the controller 50.

The switch 80 exemplifies an input manipulation receipt part which receives an input manipulation by the operator. The switch 80 has a button to be pushed by the operator when the operator starts a control to be described later for determination of the estimative load. In the embodiment, the switch 80 is disposed on a top of the left manipulation lever 66 as shown in FIG. 3. In this respect, the switch 80 is preferably at such a position as to enable the operator to manipulate the switch in the cab 12C, and thus the position of the switch 80 is not limited to the left manipulation lever 66. Moreover, the button of the switch 80 may be displayed on, for example, a screen of a display device.

The controller 50 (mechatronic controller) is composed of a computer including, for example, a CPU, a memory, and other elements, and operably has a manipulation determination part 51, a posture calculation part 52, a load calculation part 53, a reference posture setting part 54, an estimative load determination part 55, and an output part 56.

The manipulation determination part 51 determines whether a manipulation is given to the manipulation lever of each of the manipulation devices 61 to 64. In the case where each of the manipulation devices 61 to 64 is constituted by the electric manipulation device as shown in FIG. 2, each of the manipulation devices 61 to 64 inputs, to the controller 50, a manipulation signal corresponding to a manipulation amount given to the corresponding manipulation lever and a manipulation direction. The manipulation determination part 51 can determine that a manipulation is given to a certain manipulation lever of the corresponding manipulation device, specifically, can determine the manipulation amount given to the manipulation lever and the manipulation direction, in response to the input manipulation signal.

Specifically, in the embodiment, the manipulation determination part 51 can determine that: a boom raising manipulation of extending the boom cylinder 17 or a boom lowering manipulation of contracting the boom cylinder 17 is given to the manipulation lever 61A of the boom manipulation device 61; an arm pulling manipulation of extending the arm cylinder 18 or an arm pushing manipulation of contracting the arm cylinder 18 is given to the manipulation lever 62A of the arm manipulation device 62; a bucket pulling manipulation of extending the bucket cylinder 19 and a bucket pushing manipulation of contracting the bucket cylinder 19 are given to the manipulation lever 63A of the bucket manipulation device 63; and a right slewing manipulation or a left slewing manipulation of slewing the upper slewing body 12 is given to the manipulation lever 64A of the slewing manipulation device 64. In the case of the manipulation devices 61 to 64 each constituted by the electric manipulation device, the manipulation determination part 51 forms a manipulation detection part which can detect a manipulation given to each of the manipulation levers 61A to 64A of the manipulation devices 61 to 64.

In the case where each of the manipulation devices 61 to 64 is constituted by the hydraulic manipulation device, the hydraulic excavator 10 includes a plurality of unillustrated pilot pressure sensors each detecting a pilot pressure output from the remote-control valve depending on a manipulation amount given to the corresponding manipulation lever of each of the manipulation devices 61 to 64. Each of the pilot pressure sensors inputs, to the controller 50, a manipulation signal corresponding to the detected pilot pressure. The manipulation determination part 51 can determine that a manipulation is given to a certain manipulation lever of the corresponding manipulation device, specifically, can determine the manipulation amount given to the manipulation lever and the manipulation direction, in response to the input manipulation signal. In the case of the manipulation devices 61 to 64 each constituted by the hydraulic manipulation device, the pilot pressure sensors and the manipulation determination part 51 form a manipulation detection part which can detect a manipulation given to each of the manipulation levers 61A to 64A of the manipulation devices 61 to 64.

The posture calculation part 52 calculates each of the posture of the boom 14, the posture of the arm 15, and the posture of the bucket 16 in response to the posture signal input from the posture detection part. The posture calculation part 52 may calculate, for example, a boom angle θ1, an arm angle θ2, a bucket angle θ3 shown in FIG. 1 respectively as the posture of the boom 14, the posture of the arm 15, and the posture of the bucket 16 in response to the posture signal.

For instance, the boom angle θ1 may be defined between a straight line 14*a* representing the direction of the boom 14 and a plane P perpendicularly intersecting a slewing central axis C of the upper slewing body 12. In this case, the boom angle θ1 indicates a positive value when the straight line 14*a* is above the plane P, and the boom angle θ1 indicates a negative value when the straight line 14*a* is below the plane P.

The arm angle θ2 may be defined between the straight line 15*a* representing the direction of the arm 15 and the straight line 14*a*. The bucket angle θ3 may be defined between the straight line 16*a* representing the direction of the bucket 16 and the straight line 15*a*. The straight line 14*a* may connect the rotary shaft at the proximal end of the boom 14 and a rotary shaft at the distal end of the boom 14 (the rotary shaft at the proximal end of the arm 15) to each other. The straight line 15*a* may connect the rotary shaft at the proximal end of the arm 15 and a rotary shaft at the distal end of the arm 15 (the rotary shaft at the proximal end of the bucket 16) to each other. The straight line 16*a* may connect the rotary shaft at the proximal end of the bucket 16 and a distal end 16E of the bucket 16.

In the embodiment, the posture calculation part 52 and the posture detection part form a posture acquisition section which acquires the posture of the working device. Furthermore, in the embodiment, the posture calculation part 52 and the boom posture detector 31 form a boom angle acquisition part which acquires the boom angle θ1 of the boom 14 to the upper slewing body 12.

Specifically, when the boom posture detector 31 includes the inertial measurement unit, the inertial measurement unit detects, for example, an angle of the boom 14 to a horizontal plane. The posture calculation part 52 calculates, based on the angle of the boom 14 to the horizontal plane as detected by the inertial measurement unit and a tilt angle of the upper slewing body 12 to the horizontal plane as detected by an unillustrated tilt sensor, the angle (boom angle θ1) of the boom 14 to the upper slewing body 12. In a case where the boom posture detector 31 includes the stroke sensor, a stroke position of a piston in the boom cylinder 17 changes in accordance with a change in the boom angle θ1. In this case, the posture calculation part 52 calculates, based on the stroke position detected by the stroke sensor, the boom angle θ1. In a case where the boom posture detector 31 includes the position detector, for instance, the posture calculation part 52 calculates the boom angle θ1, based on position information about the position of the boom detected by the position detector and the position information about the position of the upper slewing body 12 detected by an unillustrated position detector. In a case where the boom posture detector 31 includes the angle sensor, the angle sensor forms the boom angle acquisition part.

For instance, the load calculation part 53 calculates a load of the object held by the bucket 16 in the manner which will be described below. A way of calculating the load of the object is not limited to the following calculation way, and another known way is adoptable to calculate the load.

In the embodiment, the load calculation part 53 calculates the load of the object held by the bucket 16 by using the following Equation 1.

$$M = M1 + M2 + M3 + W \times L \tag{1}$$

In Equation (1), the sign "M" denotes a moment of the boom cylinder 17 around a boom foot pin. The sign "M1" denotes a moment of the boom 14 around the boom foot pin. The sign "M2" denotes a moment of the arm 15 around the boom foot pin. The sign "M3" denotes a moment of the bucket 16 around the boom foot pin. The sign "W" denotes a load of an object, such as soil and sand, held by the bucket 16. The sign "L" denotes a horizontal distance from the boom foot pin to the proximal end of the bucket 16.

The moment M is calculated from the head pressure and the rod pressure of the boom cylinder 17. The moment M1 is calculated by a product of a distance between a gravity center of the boom 14 and the boom foot pin, and a weight of the boom 14. The moment M2 is calculated by a product of a distance between a gravity center of the arm 15 and the boom foot pin, and a weight of the arm 15. The moment M3 is calculated by a product of a distance between a gravity center of the bucket 16 and the boom foot pin, and a weight of the bucket.

A position of the gravity center of the boom 14, a position of the gravity center of the arm 15, and a position of the gravity center of the bucket 16 are calculated, based on information about the posture of the working device 13 detected by the posture detection part. The head pressure of the boom cylinder 17 is detected by the pressure sensor 35, and the rod pressure of the boom cylinder 17 is detected by the pressure sensor 36. The horizontal distance L is calculated, based on the information about the posture of the working device 13 detected by the posture detection part.

In the embodiment, the pressure sensors 35, 36 and the load calculation part 53 form a load acquisition section which acquires the load of the object held by the bucket 16. The load of the object held by the attachment may be calculated, for example, based on a value detected by a sensor, such as a load cell sensor, attached to the attachment. In this case, the load acquisition section includes the sensor, such as the load cell, and the load calculation part 53 which calculates, based on a value detected by the sensor, the load of the object.

The reference posture setting part 54 sets the boom angle θ1 acquired in the holding task as a reference posture. Specifically, the reference posture setting part 54 sets, as the reference posture, a boom angle among boom angles acquired in the holding task. A way of setting the reference posture will be described in detail later. The reference posture is a posture to be a reference for calculating a posture change amount to be described hereafter and is set to the boom angle θ1 in the holding task in the embodiment, but is not limited thereto.

The estimative load determination part 55 determines whether a predetermined estimative load determinative criterion is satisfied, the estimative load determinative criterion being for determining an estimative load of the object estimated to be discharged at the position above the dump truck in the discharge task. The estimative load determination part 55 determines the estimative load, based on the load acquired by the load acquisition section, when the estimative load determinative criterion is satisfied. In the embodiment, the estimative load determinative criterion includes a criterion that a posture change amount representing a changed degree of the posture of the working device from the reference posture is equal to or larger than a predetermined change amount threshold for determination of the estimative load.

In the embodiment, the posture change amount is an increased amount in the boom angle θ1 from the reference posture in the rising direction A11, and the change amount threshold is predetermined to a value a for determining that the work of the hydraulic excavator 10 is the loading work based on the increased amount in the boom angle θ1. In the embodiment, the posture change amount is the increased amount in the boom angle θ1 and a control of comparing the increased amount in the boom angle θ1 with the change amount threshold α is performed. Therefore, a calculation load is reducible more effectively in the embodiment than in a configuration where, for example, an increased amount in the height of a bucket 16 is calculated as the posture change amount by detecting a posture of a working device.

For instance, the change amount threshold α is set, based on data having recordation of the loading work including a plurality of discharge tasks performed by the hydraulic excavator 10 in past, to a value which enables determination that the work performed by the hydraulic excavator 10 is the loading work. In this case, in the data, each work from the holding task to the discharge task is specified, a boom raising amount (increased amount in the boom angle θ1) after the finish of the holding task is specified, and the specified increased amount in the boom angle θ1 is adopted as the change amount threshold α. Alternatively, a vertical length (load-bed height) from a lower end of a tire of the dump truck which is the loading destination to an upper end of the load bed may be adopted as the change amount threshold α. Specifically, the change amount in the boom angle θ1 acquired when the height of the distal end of the boom 14 changes in the same manner as the load-bed height may be set to the change amount threshold α. A way of setting the change amount threshold α is not limited to the aforementioned specific examples, and another way may be adoptable for successful estimation of the discharge task based on the change amount threshold α.

The output part 56 outputs an estimative result which is information about the estimative load determined by the estimative load determination part 55. The estimative result output from the output part 56 is, for example, input to a display device 70 shown in FIG. 2, and the display device 70 displays the estimative result thereon.

For instance, the output part 56 outputs, as the estimative result which is the information about the estimative load, the estimative load estimated to be discharged in the discharge task of discharging the object at the position above the loading destination. Moreover, the output part 56 may output, in real time, the load of the soil and sand (object) held by the bucket 16 when the holding task, the carrying task, and the discharge task are performed. Moreover, the output part 56 may output, in real time, the load of the soil and sand (object) held by the bucket 16 when each of the holding task, the carrying task, and the discharge task is performed. The output part 56 may output, in the discharge task, a cumulative value of the load of the soil and sand discharged to the load bed of the dump truck, a target loading amount of the soil and sand to be discharged to the load bed of the dump truck, and the number of times of the soil discharging to the load bed of the dump truck.

The display device 70 may be arranged visibly by the operator in the cab 12C of the hydraulic excavator 10. The display device 70 displaying the various kinds of information allows the operator to grasp, in real time, a difference (remaining dischargeable amount of the object) from a target loading amount (loading target) to the dump truck at the time of displaying, and grasp the load of the soil and sand (object) held by the bucket 16 at the time of the displaying.

The display device 70 may include a display for a personal computer or a mobile information terminal device located in a place different from the hydraulic excavator 10.

The hydraulic excavator 10 having the above-described configuration determines the loading work based on a changed degree of a posture of the working device from the reference posture which is the posture of the working device in the holding task, and hence can reduce the burden on the operator attributed to a setting operation depending on a situation of a work site, determine the estimative load, and output the determined estimative load.

Figure 4:
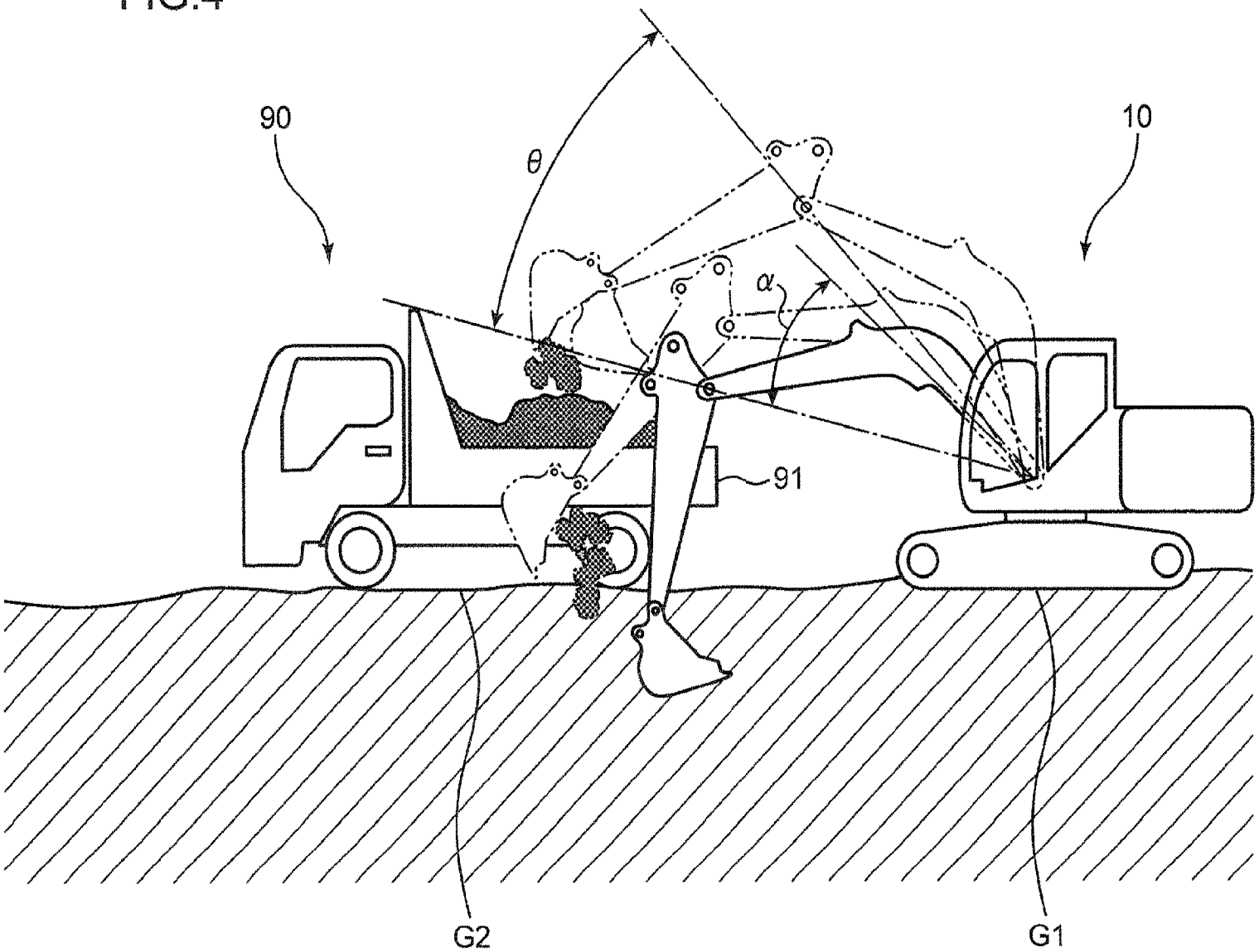
FIG. 4 is a sideview showing an example of a work site where a loading work to a load bed of a dump truck is performed by the hydraulic excavator.
Figure 5:
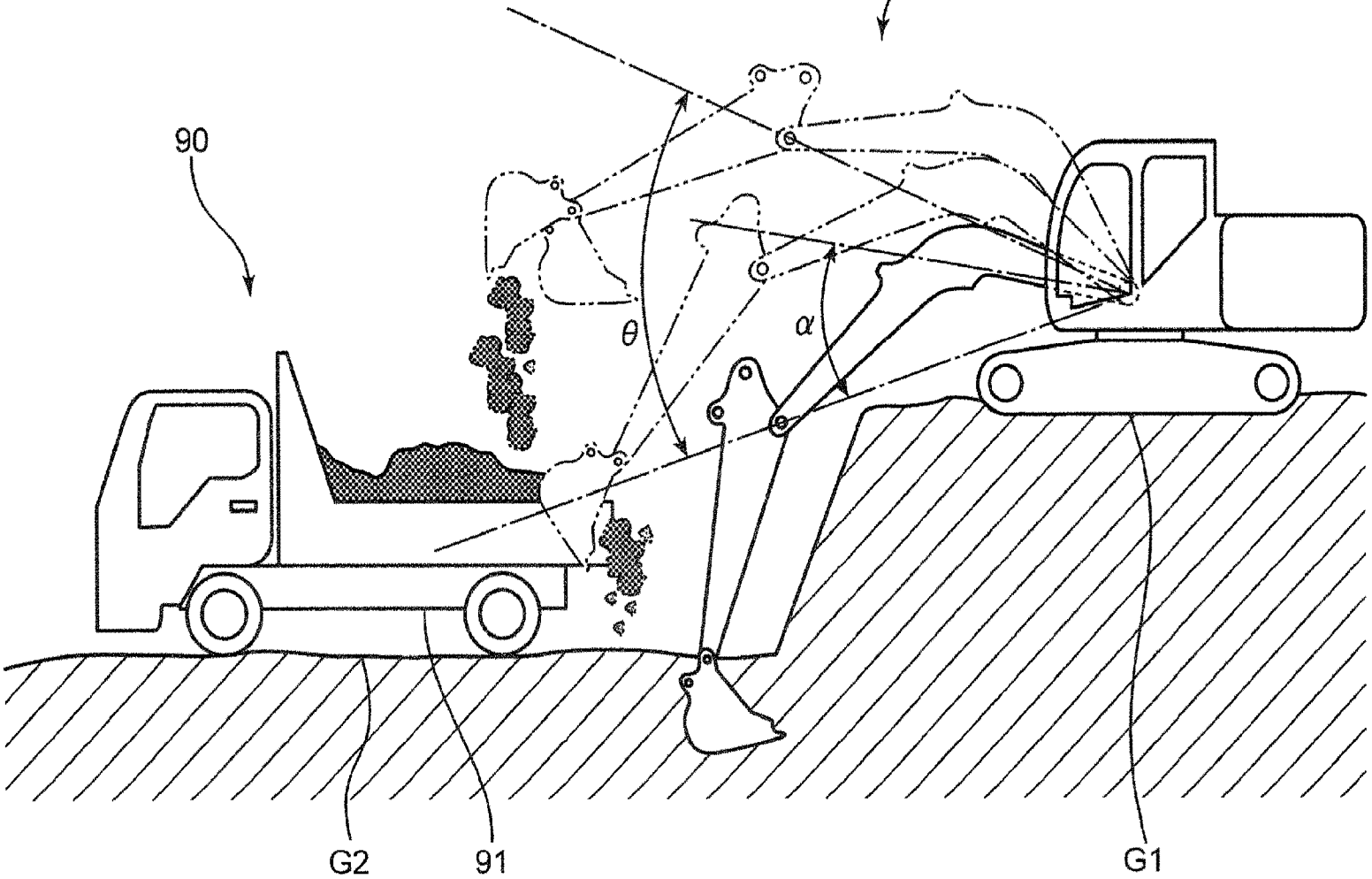
FIG. 5 is a sideview showing another example of a work site where a loading work to a load bed of a dump truck is performed by the hydraulic excavator.

FIG. 4 is a sideview showing an example of a work site where the loading work including the carrying task to the load bed of the dump truck and the discharge task is performed by the hydraulic excavator 10. FIG. 5 is a sideview showing another example of a work site where the loading work including the carrying task to the load bed of the dump truck and the discharge task is performed by the hydraulic excavator 10. In FIG. 4, a height level difference between a height level (work machine location height level) of the ground G1 where the hydraulic excavator 10 is located and a height level (truck location height level) of the ground G2 where a dump truck 90 is located indicates substantially zero. In contrast, in FIG. 5, the work machine location height level is higher than the truck location height level, and thus the height level difference between the work machine location height level and the truck location height level is large.

As shown in each of FIG. 4 and FIG. 5, typically, a load bed 91 (loading destination) of the dump truck 90 to which the soil and sand is loaded is located around the ground G2 adjacent to the ground having the soil and sand (object) to be held in the holding task in view of work efficiency on a work site. Therefore, the posture change amount acquired when the bucket 16 moves to a height level where the discharge task is performed is determined depending on a height level from the ground G2 to an upper end of the load bed 91 of the dump truck 90. Accordingly, the posture change amount acquired when the bucket 16 moves to the height level where the discharge task is performed hardly receives an influence of a height level difference, which vary depending on a situation of the work site, between the work machine location height level and the truck location height level.

The hydraulic excavator 10 determines the estimative load, based on a criterion that the aforementioned posture change amount is equal to or larger than the predetermined change amount threshold $\alpha$ for determining the estimative load. This configuration can reduce the frequency of the setting operation of changing the setting of the change amount threshold $\alpha$ depending on the situation of the work site more effectively than a conventional configuration, or can exclude the setting operation. Hereinafter, more details will be described.

As shown in FIG. 4 and FIG. 5, the work from the holding task to the discharge task further includes the boom raising operation of the boom 14 and an arm pushing operation of the arm 15. In this configuration, the bucket 16 holding the soil and sand rises from the height level of the ground (holding height level) where the soil and sand is held in the holding task to a position above the load bed 91 of the dump truck 90. That is to say, in the work from the holding task to the discharge task, the boom angle $\theta$1 of the boom 14 increases from the reference posture in the holding task along with progress of the carrying task. An increased amount $\theta$ (posture change amount $\theta$) in the boom angle $\theta$1 is determined depending on a height level from the ground G2 around which the load bed 91 of the dump truck 90 is located.

Thus, as shown in FIG. 4 and FIG. 5, a variation in the increased amount $\theta$ (posture change amount $\theta$) in the boom angle $\theta$1 can be kept relatively small even with a change in a height level difference between the work machine location height level and the truck location height level depending on the situation of the work site. The hydraulic excavator 10 according to the embodiment determines, based on the comparison between the posture change amount $\theta$ and the change amount threshold $\alpha$, whether the work of the hydraulic excavator 10 is the loading work, and determines, based on the determination, the estimative load. Accordingly, in the embodiment, this configuration is less likely to receive an influence of the change in the height level difference than a configuration where the loading work is determined, based on a height level of the attachment to the machine body or the boom angle to the machine body. This configuration can reduce the frequency of the setting operation of changing the setting of the change amount threshold depending on the situation of the work site more effectively than a conventional configuration, or can exclude the setting operation.

Figure 6:
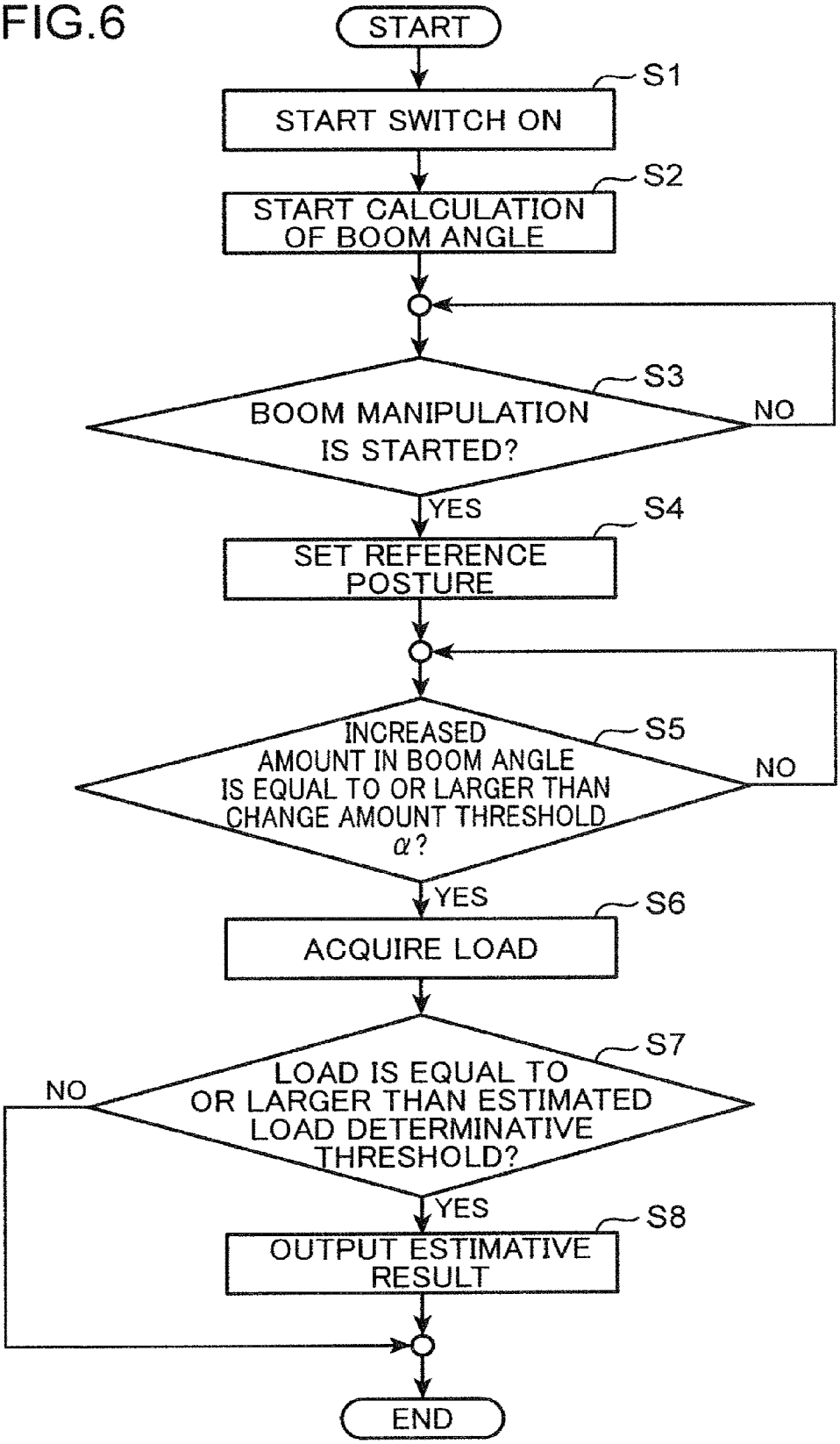
FIG. 6 is a flowchart showing a control operation to be executed by a controller.

FIG. 6 is a flowchart showing a control operation to be executed by the controller 50. In the control operation shown in FIG. 6, the estimative load determination part 55 performs a determination based on the estimative load determinative criterion, and the output part 56 outputs an estimative result about the estimative load when the estimative load determinative criterion is determined to be satisfied. More details will be described below.

The operator of the hydraulic excavator 10 performs an input manipulation of pushing the switch 80 provided to the left manipulation lever 66 when starting a control for determination of the estimative load. In response to the input manipulation, the controller 50 receives an input manipulation signal indicating that the input manipulation is performed (step S1).

The operator performs the input manipulation when starting the holding task by the hydraulic excavator 10 on the work site. Specifically, the operator manipulates at least a part of the manipulation levers 61A to 64 so that the working device has a posture (holding task start posture) to be at a start of the holding task (excavation task). The holding task start posture represents, for example, a posture at which the bucket 16 is located above and near an excavation target place. After the posture of the working device is adjusted to the holding task start posture, the operator performs the input manipulation of pushing the switch 80. The operator can make the control for determination of the loading work (control for determination of the estimative load) effective by the switch 80, if necessary.

Subsequently, the posture calculation part 52 starts to calculate the boom angle $\theta$1 (step S2). The posture calculation part 52 calculates the boom angle $\theta$1 in response to the posture signal input from the boom posture detector 31 to the controller 50. The posture calculation part 52 may continuously calculate the boom angle $\theta$1 in execution of the control operation shown in FIG. 6.

Then, the reference posture setting part 54 sets the boom angle $\theta$1 acquired in the holding task as a reference posture (steps S3, S4). Specifically, the reference posture setting part 54 sets, as the reference posture, the boom angle $\theta$1 acquired after the switch 80 receives the input manipulation.

Specifically, the reference posture setting part 54 determines whether the boom raising manipulation is started in the holding task (step S3). When the boom raising manipulation is started in the holding task (YES in step S3), the reference posture setting part 54 sets the boom angle $\theta$1 at the start of the boom raising manipulation in the holding task as the reference posture (step S4).

The reference posture setting part 54 can determine that the boom raising manipulation is started in the holding task, for example, in the following manner. The reference posture setting part 54 may determine a start time of the holding task in response to a signal (holding task start signal) indicating the start time of the holding task, and determines a finish time of the holding task in response to a signal (holding task finish signal) indicating the finish time of the holding task. In this manner, the boom angle θ1 at the start time of the boom raising operation, at which the discharge task is highly likely to be presumed, is set as the reference posture, and thus the holding task can be appropriately determined.

The holding task start signal can cover various aspects depending on a specific content of the holding task, and thus is not particularly limited and covers the following specific examples.

Specifically, the holding task start signal may be, for example, an input manipulation signal input to the controller 50 accompanied by the input manipulation received by the switch 80, or may be a bucket pulling manipulation signal indicating that the bucket manipulation lever 63A receives the bucket pulling manipulation after the input manipulation signal is input.

The holding task finish signal can cover various aspects depending on a specific content of the holding task, and thus is not particularly limited and covers the following specific examples.

Specifically, the holding task (excavation task) typically excludes the slewing operation of the upper slewing body 12. In contrast, the loading work typically includes the boom raising operation and the slewing operation. Hence, after the input manipulation signal is input to the controller 50, the reference posture setting part 54 can determine, as a finish time of the holding task, a time at which the controller 50 receives the input of the slewing manipulation signal indicating that the slewing manipulation lever 64 receives the slewing manipulation. In this case, the holding task finish signal represents the slewing manipulation signal. Moreover, in response to an input of a boom raising manipulation signal indicating that the boom manipulation lever 61A receives the boom raising manipulation to the controller 50 after the start time of the holding task and before the finish time of the holding task, the reference posture setting part 54 can determine that the boom raising manipulation is started in the holding task.

The reference posture setting part 54 may determine the finish time of the holding task, for example, in the following manner. The bucket 16 holds the excavated soil and sand after the holding task (excavation task), and therefore, the load acquired by the load acquisition section is larger than that acquired before the start of the holding task. Thus, after the input manipulation signal is input to the controller 50, the reference posture setting part 54 can determine, as the finish time of the holding task, a time at which the load acquired by the load acquisition section reaches a predetermined threshold (holding task finish determinative threshold) or larger.

Subsequently, the estimative load determination part 55 determines whether the estimative load determinative criterion is satisfied (steps S5, S7). In the embodiment, the estimative load determinative criterion means that a criterion (angle criterion) that an increased amount in the boom angle θ1 from the reference posture is equal to or larger than the change amount threshold α is satisfied, and that a criterion (load criterion) that the load held by the bucket 16 is equal to or larger than an estimative load determinative threshold is satisfied.

In this respect, first, the estimative load determination part 55 determines whether the increased amount in the boom angle θ1 from the reference posture is equal to or larger than the change amount threshold α (step S5). When the increased amount in the boom angle θ1 is equal to or larger than the change amount threshold α (YES in step S5), the load acquisition section acquires the load of the soil and sand held by the bucket 16 at that time (step S6).

Next, the estimative load determination part 55 determines whether the load acquired by the load acquisition section is equal to or larger than the estimative load determinative threshold (step S7). The estimative load determinative threshold is, for example, predetermined to a value for determining whether the soil and sand is substantially held by the bucket 16. Specifically, the bucket 16 typically holds a certain amount of the soil and sand immediately before the discharge task. In contrast, the discharge task is highly unlikely to be performed in a case where the soil and sand is not held by the bucket 16 or a case where the amount of the soil and sand even being held is very small. In this aspect, the estimative load determinative criterion includes the criterion that the load of the soil and sand held by the bucket 16 is equal to or larger than the estimative load determinative threshold, and hence, the estimative load is more appropriately determined.

When the load acquired by the load acquisition section is equal to or larger than the estimative load determinative threshold (YES in step S7), the estimative load determination part 55 determines, as the estimative load, a load of the soil and sand acquired by the load acquisition section at this time, i.e., a load of the soil and sand acquired by the load acquisition section when the estimative load determinative criterion is satisfied.

The output part 56 outputs, as the estimative result, the estimative load determined by the estimative load determination part 55 (step S8). Conversely, when the load acquired by the load acquisition section is smaller than the estimative load determinative threshold (NO in step S7), the output part 56 avoids outputting the load as the estimative result.

The present invention should not be limited to the embodiment described above. The present invention covers, for example, aspects to be described below.

(A) Update of Reference Posture

After starting the manipulation for carrying the object held in the holding task to the position above the loading destination, the operator may suspend the manipulation or may reperform the holding task prior to the discharge task. In this case, determination of the estimative load based on the reference posture already set at this time is unfavorable. Accordingly, in this case, the reference posture setting part 54 in the work machine may update the reference posture, in a case where a predetermined update criterion for determining whether to update the reference posture is satisfied before the estimative load determinative criterion is satisfied after the reference posture is set. The reference posture setting part 54 may update the reference posture by revising the reference posture to the boom angle θ1 determined among boom angles of the hydraulic excavator 10 in the holding task performed after the update criterion is satisfied. In this case, the estimative load determination part 55 determines, based on the updated reference posture, whether the estimative load determinative criterion is satisfied. Even after the reference posture is determined once, the reference posture is updated when the update criterion is satisfied. It is determined, based on the updated reference posture, whether the estimative load determinative criterion is satisfied. Specifically, in this aspect, the reference posture is updatable to a more suitable reference posture depending on an operation situation of the hydraulic excavator 10. Furthermore, it is more appropriately determined, based on the updated reference posture, whether the estimative load determinative criterion is satisfied.

The update criterion can cover, for example, the following aspects.

The update criterion may include a criterion that the load of the soil and sand acquired by the load acquisition section is equal to or smaller than a predetermined update determinative load threshold before the estimative load determinative criterion is satisfied after the reference posture is set. For instance, the operator may reperform the loading work when the soil and sand held by the bucket 16 is less than expected by the operator even after the loading work is started once. Presumed in this case is a situation where a portion of or whole of the object being held is discharged from the bucket 16 before the estimative load determinative criterion is satisfied, and thus, the holding task is highly likely to be reperformed thereafter. The updating of the reference posture may be appropriately determined by comparing the load of the object with the update determinative load threshold in this manner. Even when the soil and sand is discharged from the bucket 16, some of the soil and sand adhered to the bucket 16 may remain at the bucket. Hence, the update determinative load threshold may be set to a value larger than zero at which the reference posture is updatable even when the soil and sand adhered to the bucket 16 remains as adhered.

Furthermore, the update criterion may include a criterion that the boom 14 operates in the lowering direction A12 before the estimative load determinative criterion is satisfied after the reference posture is set. In the loading work, the boom 14 performs the boom raising operation to scoop up the soil and sand in response to the boom raising manipulation to the boom manipulation lever 61A. In contrast, when the boom 14 performs the boom lowering operation in response to the boom lowering manipulation to the boom manipulation lever 61A, the loading work is presumed to be highly likely reperformed. For instance, when the manipulation determination part 51 determines that the boom lowering manipulation is given to the boom manipulation lever 61A, the reference posture setting part 54 can determine that the boom 14 operates in the lowering direction A12.

Furthermore, the update criterion may include a criterion that a reduced amount in the boom angle θ1 in the lowering direction A12 is equal to or larger than a predetermined reduction amount threshold before the estimative load determinative criterion is satisfied after the reference posture is set. In this aspect, such a situation that the holding task is reperformed can be presumed when the boom shifts from the boom raising operation to the boom lowering operation, and thus the updating of the posture is more appropriately determined.

The update criterion may include a criterion that a predetermined reduction manipulation of reducing the amount of the soil and sand held by the bucket 16 is detected before the estimative load determinative criterion is satisfied after the reference posture is set. For example, the reduction manipulation may include the bucket pushing manipulation. For example, the reduction manipulation may include the arm pushing manipulation. In the aspect, updating of the reference posture is more appropriately determined.

(B) Posture of Working Device

Although the reference posture setting part 54 sets the boom angle θ1 in the holding task as the reference posture, and the posture change amount is the increased amount in the boom angle θ1 in the rising direction A11 from the reference posture in the embodiment, the present invention is not limited to this aspect.

For instance, the reference posture setting part 54 may set a specific height level (vertical position) of the attachment in the holding task as the reference posture, and the posture change amount may be an increased amount in the height level of the attachment upward from the reference posture. In other words, the reference posture setting part in the present invention may set, as the reference posture, a specific posture among postures of the working device in the holding task.

(C) Estimative Load Determinative Criterion

In the embodiment, the estimative load determinative criterion means that a criterion (angle criterion) that an increased amount in the boom angle θ1 from the reference posture is equal to or larger than the change amount threshold α is satisfied, and that a criterion (load criterion) that the load held by the bucket 16 is equal to or larger than an estimative load determinative threshold is satisfied, but is not limited to this aspect.

The estimative load determinative criterion may include at least the angle criterion, and thus may exclude the load criterion.

The estimative load determinative criterion may further include, for example, a criterion that the boom angle θ1 from the reference posture continues to increase until the increased amount in the boom angle θ1 reaches the change amount threshold. When the boom angle θ1 does not continue to increase, an operation or task other than the discharge task, such as adjustment of the position of the attachment, is presumed to be performed. In the aspect, the estimative load is more appropriately determined.

(D) Reference Posture Setting Part

In the embodiment, the reference posture setting part 54 sets, as the reference posture, the boom angle θ1 at the start of the boom raising manipulation in the holding task, but is not limited to this aspect. As exemplified below, the reference posture setting part 54 may set, as the reference posture, a posture determined among the postures of the working device in the holding task.

For instance, the reference posture setting part 54 may set, as the reference posture, a minimum value of a plurality of boom angles θ1 acquired by the boom angle acquisition part in the holding task.

Alternatively, the reference posture setting part 54 may set, as the reference posture, the boom angle θ1 acquired when the switch 80 (which is an example of an input manipulation receipt part) receives the input manipulation.

Further alternatively, the reference posture setting part 54 may set, as the reference posture, the boom angle θ1 at the finish time of the holding task.

(E) Output Part

Although the output part 56 outputs, as the estimative result, the estimative load estimated to be discharged in the discharge task of discharging the object at the position above the loading destination when the estimative load determination part 55 determines that the estimative load determinative criterion is satisfied in the embodiment, the present invention is not limited to this aspect. The estimative result output by the output part may sufficiently assist the work performed by the work machine. Examples of the estimative result may include information for notifying the operator that the discharge task is estimated or not estimated in the work of the work machine, based on a determination result by the estimative load determination part, and the information may be displayed on, for example, the display device.

(F) Work Machine

The work machine is described as the hydraulic excavator 10 in the embodiment, but is not limited thereto and may be another work machine, e.g., a wheel loader.

(G) Attachment

The attachment includes the bucket 16 in the embodiment, but is not limited thereto. The attachment may include other attachment, e.g., a fork, and a grapple. Each of the fork and the grapple serves as an attachment which can hold an object of a work. Each of the fork and the grapple includes a plurality of arms openable and closable to catch and hold the object of the work, like carrying goods and waste woods.

(H) Other Modifications

The switch 80 is excludable in the hydraulic excavator 10.

Conclusively, the present invention provides a work machine which can reduce a burden on an operator attributed to a setting operation depending on a situation of a work site, and output an estimative result which is information about an estimative load estimated to be discharged in a discharge task.

Provided is a work machine which performs a holding task of holding an object of a work, and a discharge task of discharging the object at a position above a loading destination. The work machine includes: a machine body; a working device which includes a boom supported on the machine body tiltably in a rising direction and a lowering direction, and an attachment for holding the object in the holding task; a posture acquisition section which acquires a posture of the working device; a load acquisition section which acquires a load of the object held by the attachment; a reference posture setting part which sets a reference posture which is one of postures of the working device in the holding task; an estimative load determination part which determines, based on the load acquired by the load acquisition section, an estimative load of the object estimated to be discharged at the position above the loading destination in the discharge task when a predetermined estimative load determinative criterion is satisfied; and an output part which outputs an estimative result which is information about the estimative load determined by the estimative load determination part. The estimative load determinative criterion includes a criterion that a posture change amount representing a changed degree of the posture of the working device from the reference posture is equal to or larger than a predetermined change amount threshold for determination of the estimative load.

In the work machine, the estimative load is determined, based on the criterion that the posture change amount is equal to or larger than the change amount threshold. This configuration can reduce the frequency of the setting operation of changing the setting of the change amount threshold depending on the situation of the work site more effectively than a conventional configuration, or can exclude the setting operation. Therefore, the work machine can reduce the burden on the operator attributed to the setting operation depending on the situation of the work site, and output the estimative result which is the information about the estimative load estimated to be discharged in the discharge task of discharging the object at the position above the loading destination.

In the work machine, it is preferable that the posture acquisition section includes a boom angle acquisition part which acquires a boom angle of the boom to the machine body, the reference posture setting part sets the boom angle acquired in the holding task as the reference posture, and that the posture change amount is an increased amount in the boom angle from the reference posture in the rising direction.

In many cases, the discharge task of discharging the object at the position above the loading destination includes a boom raising operation of causing the boom to rise in the rising direction and increasing the boom angle so that the attachment holding the object reaches above the loading destination. In this aspect, the estimative load is determined, based on the increased amount in the boom angle from the reference posture. This configuration can reduce a calculation load more effectively than a configuration where the estimative load is determined by detecting the posture of the working device and calculating the height level of the attachment.

The work machine preferably further includes a boom manipulation device for receiving a boom raising manipulation of raising the boom in the rising direction. The reference posture setting part preferably sets, as the reference posture, the boom angle acquired when the boom raising manipulation is started in the holding task.

In a process of the holding task of holding the object by the attachment, the boom raising operation is started to scoop up the object held by the attachment in many cases. In this aspect, the boom angle acquired at the start of the boom raising operation in the holding task can be set as the reference posture. The estimative load is appropriately determinable since the boom angle at the start of the boom raising operation, at which the discharge task of discharging the object at the position above the loading destination is highly likely to be presumed, is set as the reference posture.

In the work machine, the estimative load determinative criterion may further include a criterion that the boom angle from the reference posture continues to increase until the increased amount in the boom angle reaches the change amount threshold.

The discharge task of discharging the object at the position above the loading destination and the carrying task include the boom raising operation of continuously increasing the boom angle in many cases. When the boom angle does not continue to increase, an operation or task other than the discharge task, such as adjustment of the position of the attachment, is presumed to be performed. In the aspect, the estimative load is more appropriately determined.

In the work machine, the output part preferably outputs the load acquired by the load acquisition section as the estimative load when the estimative load determinative criterion is satisfied.

In this aspect, the operator can grasp the load of the object estimated to be discharged to the loading destination in the discharge task. Consequently, the work on the work site by the operator is effectively assisted.

The work machine preferably further includes an input manipulation receipt part which receives an input manipulation by an operator. The reference posture setting part preferably sets, as the reference posture, a posture of the working device acquired after the input manipulation receipt part receives the input manipulation.

In this aspect, the setting of the reference posture by the reference posture setting part is limited to a time after the input manipulation by the operator, and therefore, the operator can make the control of determining the estimative load effective, if necessary.

In the work machine, the estimative load determinative criterion may further include a criterion that the load of the object acquired by the load acquisition section is equal to or larger than an estimative load determinative threshold.

The attachment typically holds a certain amount of the object when the discharge task of discharging the object at the position above the loading destination is performed. In contrast, the discharge task is highly unlikely to be performed in a case where the object is not held by the attachment or a case where the amount of the object even being held is very small. In this aspect, the estimative load determinative criterion includes the criterion that the load of the object held by the attachment is equal to or larger than the estimative load determinative value. Accordingly, the estimative load is more appropriately determined.

In the work machine, the reference posture setting part preferably updates the reference posture to one of postures of the working device in the holding task to be executed after a time when a predetermined update criterion for determination as to whether to update the reference posture is satisfied before the estimative load determinative criterion is satisfied after the reference posture is set. The estimative load determination part preferably determines, based on the updated reference posture, whether the estimative load determinative criterion is satisfied.

After starting the manipulation for carrying the object held in the holding task to the position above the loading destination, the operator may suspend the manipulation or may reperform the holding task prior to the discharge task. In this case, determination of the estimative load based on the reference posture already set at this time is unfavorable. Accordingly, in this aspect, even after the reference posture is determined once, the reference posture is updated when the update criterion is satisfied. Further, it is determined, based on the updated reference posture, whether the estimative load determinative criterion is satisfied. Specifically, in this aspect, the reference posture is updatable to a more suitable reference posture depending on an operation situation of the working device. Accordingly, it is more appropriately determined, based on the updated reference posture, whether the estimative load determinative criterion is satisfied.

In the work machine, the update criterion may include a criterion that the load of the object acquired by the load acquisition section is equal to or smaller than a predetermined update determinative load threshold before the estimative load determinative criterion is satisfied after the reference posture is set.

For instance, when the load of the object is equal to or smaller than the update determinative load threshold, presumed is a situation where a portion of or a whole of the object being held is discharged from the attachment before the estimative load determinative criterion is satisfied after the object is held by the attachment in the holding task once. In this case, the holding task is highly likely to be reperformed. Therefore, in this aspect, the updating of the reference posture can be more appropriately determined by comparing the load of the object with the update determinative load threshold.

Moreover, in the work machine, the update criterion may include a criterion that the boom is lowered in the lowering direction before the estimative load determinative criterion is satisfied after the reference posture is set.

Such a situation that the holding task is reperformed is presumed when the boom shifts from the boom raising operation to the boom lowering operation of operating in the boom lowering direction. Consequently, in this aspect, the updating of the reference posture is determinable, based on the determination as to whether the criterion that the boom operates in the lowering direction is satisfied.

The invention claimed is:

1. A work machine which performs an excavation task of excavating soil and sand of ground on a work site by a bucket to hold the excavated soil and sand by the bucket, and a discharge task of discharging the excavated soil and sand from the bucket at a position above a loading destination, the work machine comprising:

a machine body;

a working device which includes a boom supported on the machine body tiltably in a rising direction and a lowering direction, and the bucket for excavating the soil and sand in the excavation task;

a posture acquisition section including a posture detector and configured to acquire a posture of the working device;

a load acquisition section including a sensor and configured to acquire a load of the soil and sand held by the bucket;

an input manipulation receipt part including a switch configured to receive an input manipulation by an operator; and a controller configured to set a reference posture which is one of postures of the working device in the excavation task, the reference posture being a posture of the working device acquired after the switch receives the input manipulation;

determine that the working device has moved to a height level where the discharge task is to be performed based on a posture change amount being equal to or larger than a predetermined change amount threshold for determination of an estimative load of the soil and sand estimated to be discharged at the position above the loading destination in the discharge task, the posture change amount representing a changed degree of the posture of the working device from the reference posture;

determine, based on the load acquired by the load acquisition section, the estimative load when a predetermined estimative load determinative criterion is satisfied, the predetermined estimative load determinative criterion including a first criterion that the posture change amount is equal to or larger than the predetermined change amount threshold; and output an estimative result which is information about the estimative load determined by the controller.

2. A work machine which performs an excavation task of excavating soil and sand of ground on a work site by a bucket to hold the excavated soil and sand by the bucket, and a discharge task of discharging the excavated soil and sand from the bucket at a position above a loading destination, the work machine comprising:

a machine body;

a working device which includes a boom supported on the machine body tiltably in a rising direction and a lowering direction, and the bucket for excavating the soil and sand in the excavation task;

a posture acquisition section including a posture detector and configured to acquire a posture of the working device;

a load acquisition section including a sensor and configured to acquire a load of the soil and sand held by the bucket; and a controller configured to set a reference posture which is one of postures of the working device in the excavation task;

determine that the working device has moved to a height level where the discharge task is to be performed based on a posture change amount being equal to or larger than a predetermined change amount threshold for determination of an estimative load of the soil and sand estimated to be discharged at the position above the loading destination in the discharge task, the posture change amount representing a changed degree of the posture of the working device from the reference posture;

determine, based on the load acquired by the load acquisition section, the estimative load when a predetermined estimative load determinative criterion is satisfied, the predetermined estimative load determinative criterion including a first criterion that the posture change amount is equal to or larger than the predetermined change amount threshold; and output an estimative result which is information about the estimative load determined by the controller.

3. The work machine according to claim 2, wherein the posture acquisition section includes a boom angle acquisition part which acquires a boom angle of the boom to the machine body, the controller is configured to set the boom angle acquired in the excavation task as the reference posture, and the posture change amount is an increased amount in the boom angle from the reference posture in the rising direction.

4. The work machine according to claim 3, further comprising:

a boom manipulation device for receiving a boom raising manipulation of raising the boom in the rising direction, wherein the controller is configured to set, as the reference posture, the boom angle acquired when the boom raising manipulation is started in the excavation task.

5. The work machine according to claim 3, wherein the estimative load determinative criterion further includes a second criterion that the boom angle from the reference posture continues to increase until the increased amount in the boom angle reaches the change amount threshold.

6. The work machine according to claim 3, wherein the controller is configured to set, as the reference posture, a minimum value of the boom angle in the excavation task.

7. The work machine according to claim 3, wherein the controller is configured to set, as the reference posture, the boom angle at a finish time of the excavation task.

8. The work machine according to claim 2, wherein the controller is configured to output, as the estimative load, the load acquired by the load acquisition section when the estimative load determinative criterion is satisfied.

9. The work machine according to claim 2, wherein the estimative load determinative criterion further includes a third criterion that the load of the soil and sand acquired by the load acquisition section is equal to or larger than an estimative load determinative threshold.

10. The work machine according to claim 2, wherein the controller is configured to update the reference posture to one of postures of the working device in the excavation task to be executed after a time when a predetermined update criterion is satisfied before the estimative load determinative criterion is satisfied after the reference posture is set, the update criterion being for determination as to whether to update the reference posture, and the controller is configured to determine, based on the updated reference posture, whether the estimative load determinative criterion is satisfied.

11. The work machine according to claim 10, wherein the update criterion includes a criterion that the load of the soil and sand acquired by the load acquisition section is equal to or smaller than a predetermined update determinative load threshold before the estimative load determinative criterion is satisfied after the reference posture is set.

12. The work machine according to claim 10, wherein the update criterion includes a criterion that the boom is lowered in the lowering direction before the estimative load determinative criterion is satisfied after the reference posture is set.

13. The work machine according to claim 2, further comprising:

an input manipulation receipt part including a switch configured to receive an input manipulation by an operator, wherein the controller is configured to set, as the reference posture, a posture of the working device acquired after the switch receives the input manipulation.

14. The work machine according to claim 2, further comprising:

an input manipulation receipt part including a switch configured to receive an input manipulation by an operator, wherein the controller is configured to set, as the reference posture, a posture of the working device acquired when the switch receives the input manipulation.

* * * * *